US007339544B2

(12) United States Patent
Jeung

(10) Patent No.: US 7,339,544 B2
(45) Date of Patent: Mar. 4, 2008

(54) ARRAY ANTENNA FOR SUPPRESSING BACK SIGNAL AND METHOD FOR DESIGNING THE SAME

(76) Inventor: Ha Jae Jeung, 307-101 Buyeong Apt. 3-Danji, Donong-Dong, Namyangju-Si, Gyeonggi-Do 472-793 (KR)

( * ) Notice: Subject to any disclaimer, the term of this patent is extended or adjusted under 35 U.S.C. 154(b) by 0 days.

(21) Appl. No.: 10/598,863

(22) PCT Filed: Jun. 24, 2005

(86) PCT No.: PCT/KR2005/001983

§ 371 (c)(1),
(2), (4) Date: Sep. 13, 2006

(87) PCT Pub. No.: WO2006/001662

PCT Pub. Date: Jan. 5, 2006

(65) Prior Publication Data

US 2007/0182635 A1 Aug. 9, 2007

(30) Foreign Application Priority Data

Jun. 28, 2004 (KR) ..... 10-2004-0048743

(51) Int. Cl.
*H01Q 21/00* (2006.01)

(52) U.S. Cl. ..... 343/817; 343/810; 343/754

(58) Field of Classification Search ..... 343/810, 343/815, 817, 818, 819, 833, 754
See application file for complete search history.

(56) References Cited

U.S. PATENT DOCUMENTS 5,909,195 A * 6/1999 Merenda ..... 343/815

(Continued)

FOREIGN PATENT DOCUMENTS

JP 2000-124733 4/2000

(Continued)

*Primary Examiner*—Hoang V. Nguyen
(74) *Attorney, Agent, or Firm*—IPLA P.A.; James E. Bame

(57) ABSTRACT

The present invention provides a method for designing a front directional array antenna for suppressing a back signal used in a wireless communication, comprising: (a) an analogous pattern element arranging step for arranging, on a reflecting panel which is a conductor at a predetermined interval, elements having mutual analogous emission pattern characteristic for a short axis (x axis) in which the number of arrangements is small and for a long axis (y axis) which is a perpendicular direction to the x axis; (b) a reception balancing step for forming, in the edge of the reflecting panel, reflecting surfaces having a predetermined angle and length which are symmetric centering on the front surface to direction of electric wave arrived to the elements located in the edge; (c) an x-axis direction signal suppressing step, by x-axis series distribution and synthesis, for performing as many series distribution and synthesis suppressing transfer characteristic in an x-axis direction as the number of y rows, for output distribution and synthesis for the x axis arrangement, in synthesizing a signal of the array antenna after the step (b); (d) a y-axis direction signal suppressing step, by y-axis series distribution and synthesis, for performing series distribution and synthesis suppressing transfer characteristic in a y-axis direction in finally performing distribution and synthesis in the y-axis direction, for output distribution and synthesis for the x axis arrangement; and (e) a back-suppressed sold pattern outputting step for providing result of arrangement signal distribution and synthesis of the y axis to a contact means outside the antenna device.

4 Claims, 6 Drawing Sheets

BACK-SUPPRESSED SIGNAL BEAM PATTERN DIAGRAM

U.S. PATENT DOCUMENTS 6,339,407 B1 * 1/2002 Gabriel et al. ..... 343/797
6,943,732 B2 * 9/2005 Gottl et al. ..... 343/700 MS

FOREIGN PATENT DOCUMENTS

JP 2001-127534 5/2001
KR 1020030058027 7/2003

* cited by examiner

[Fig. 1]
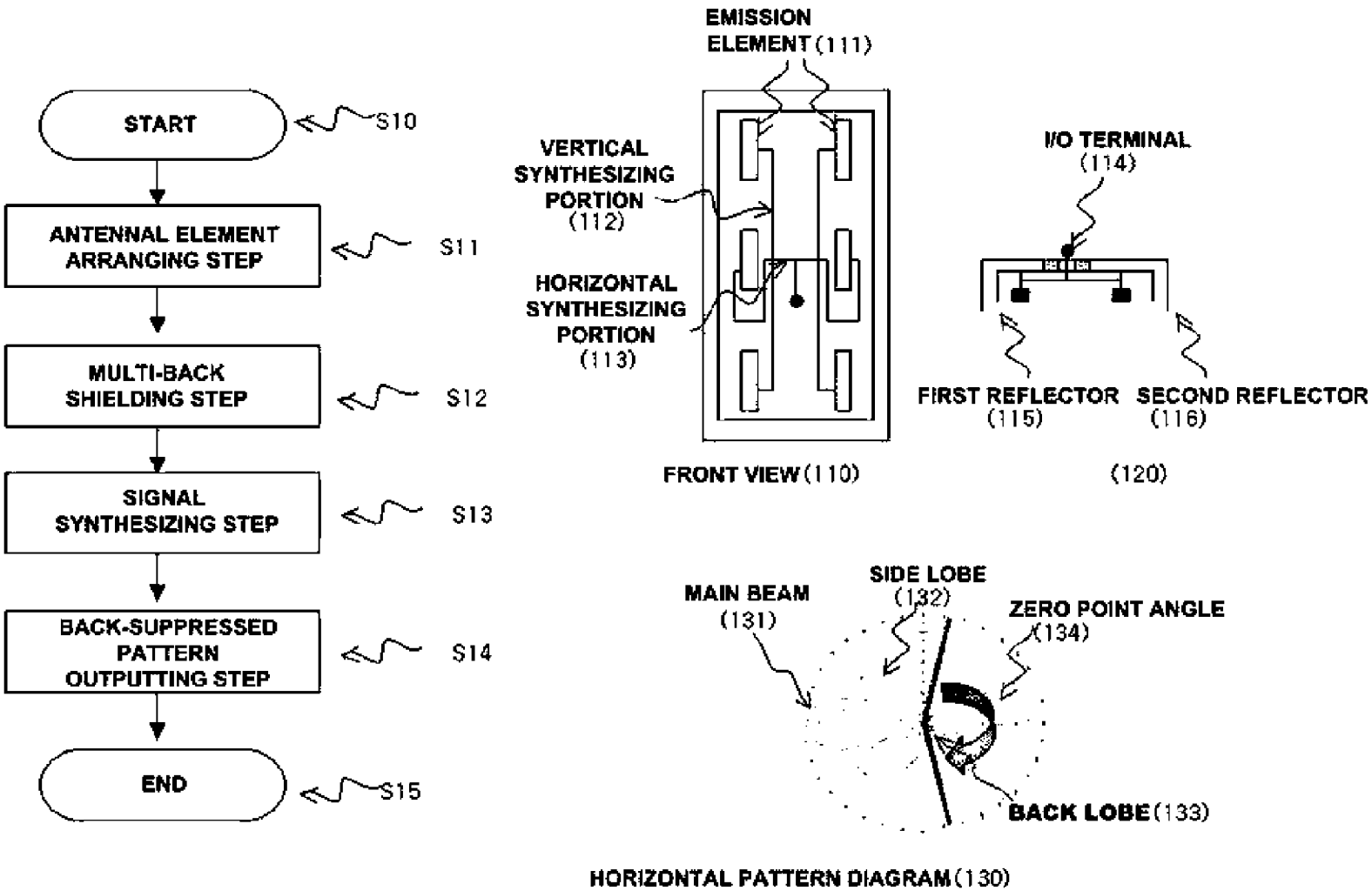

[Fig. 2]
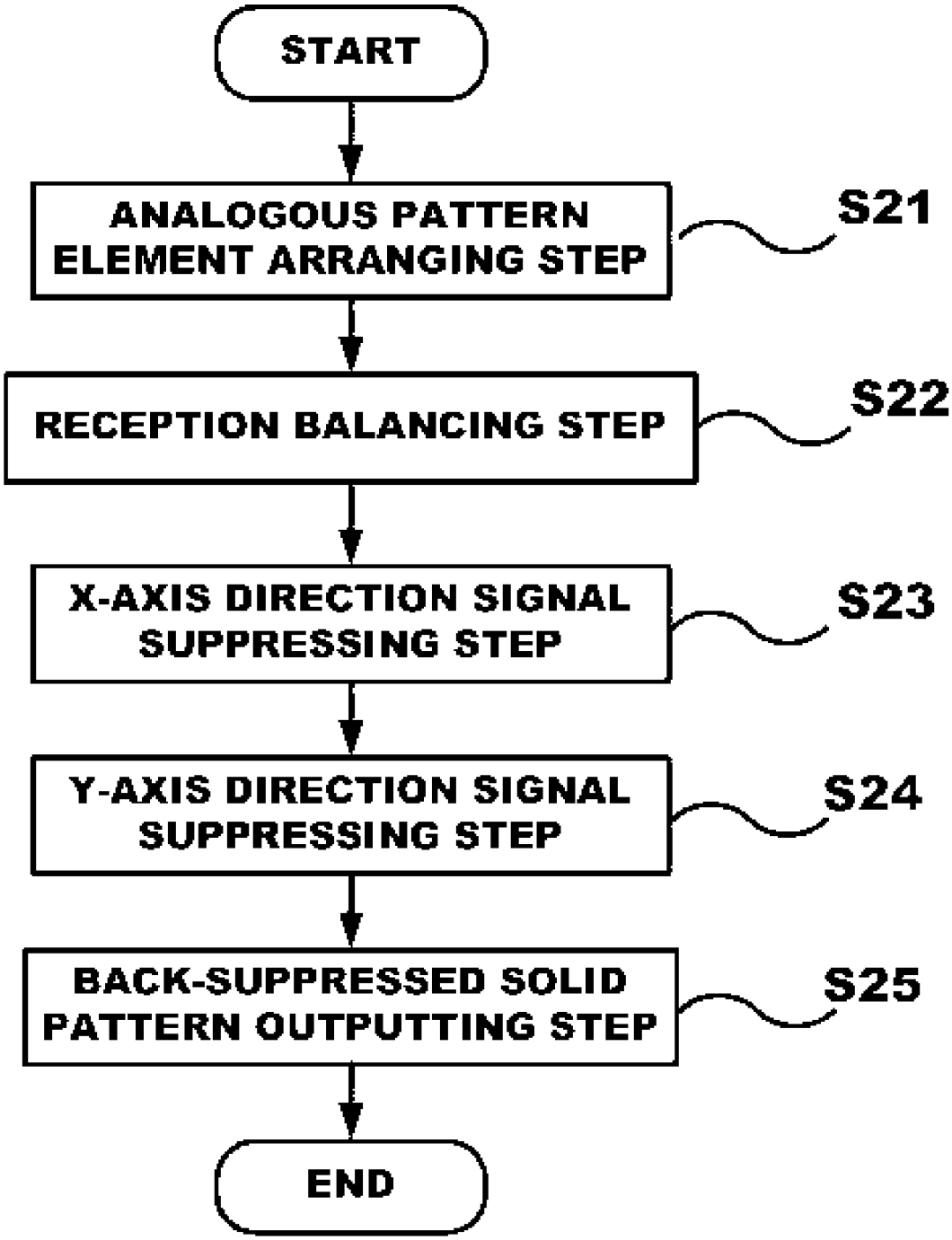

[Fig. 3]
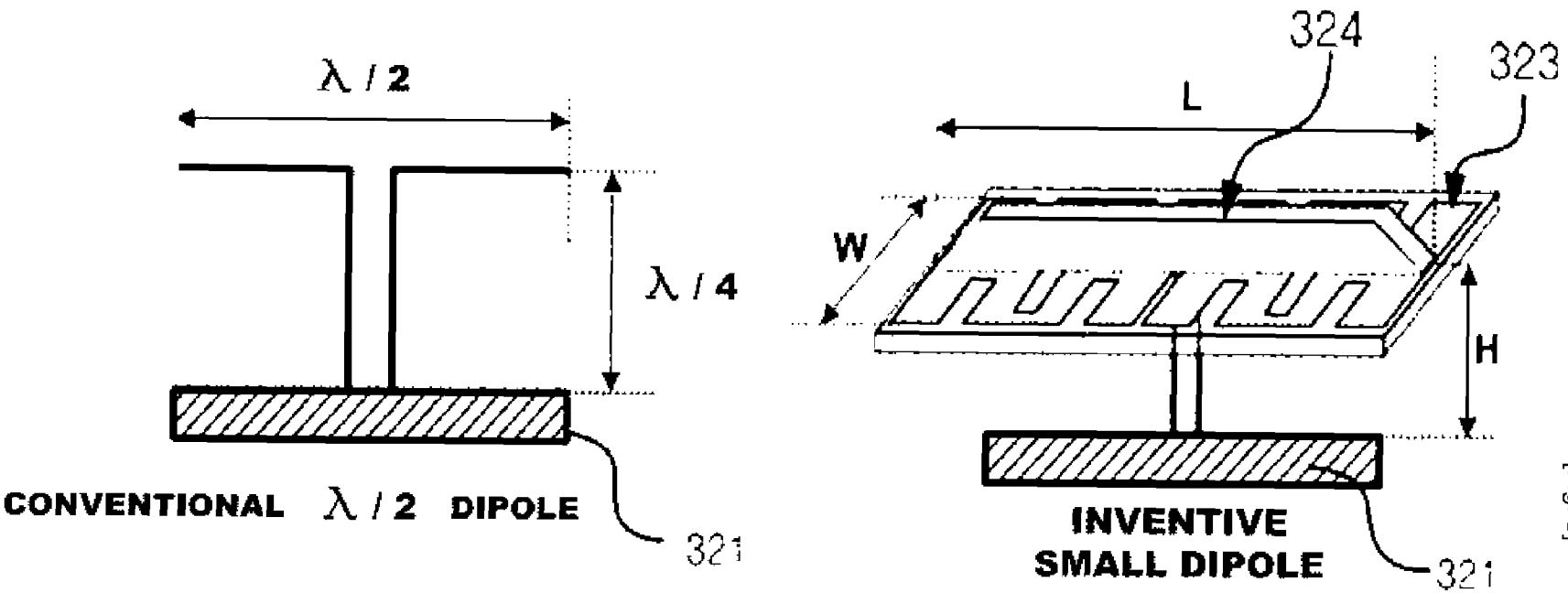

[Fig. 4]
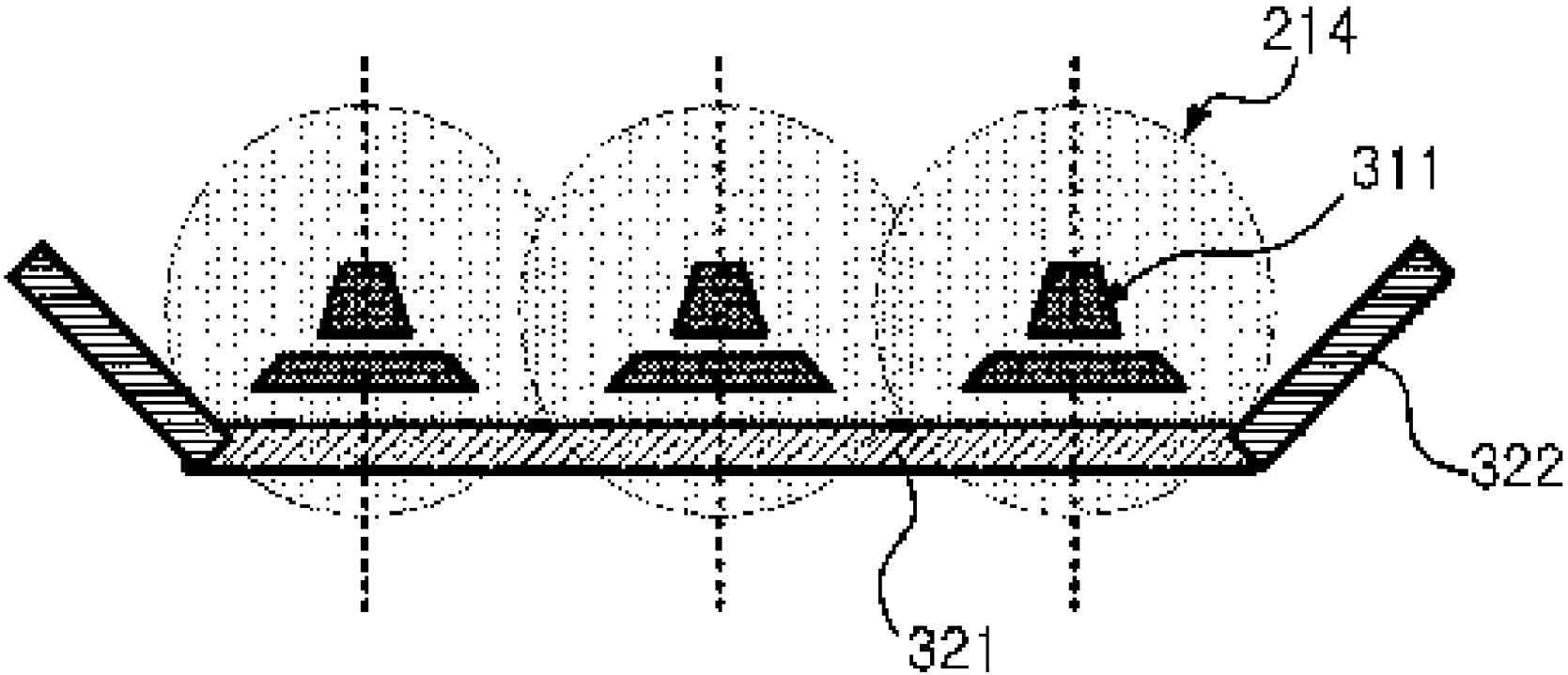

[Fig. 5]
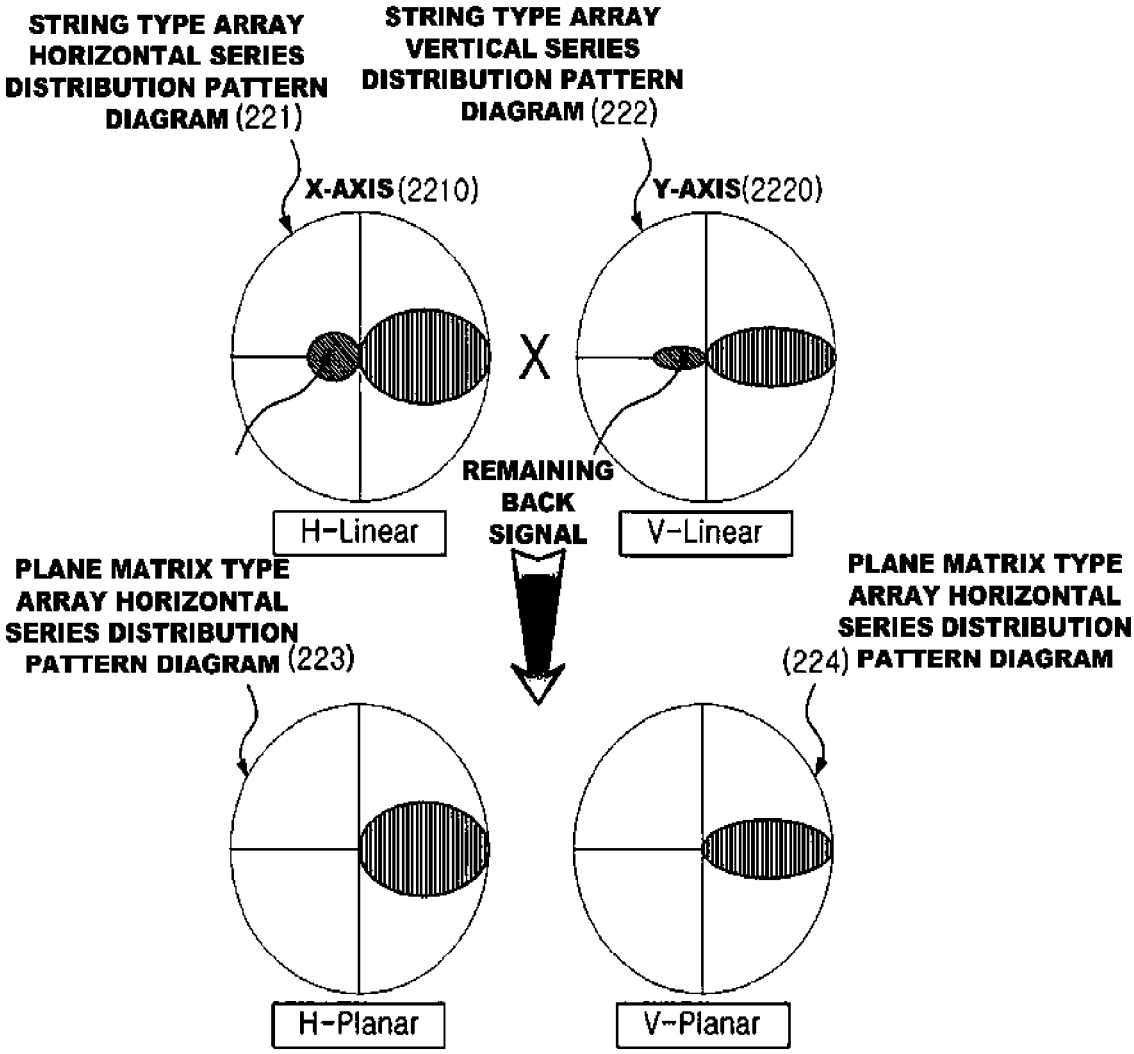

[Fig. 6]
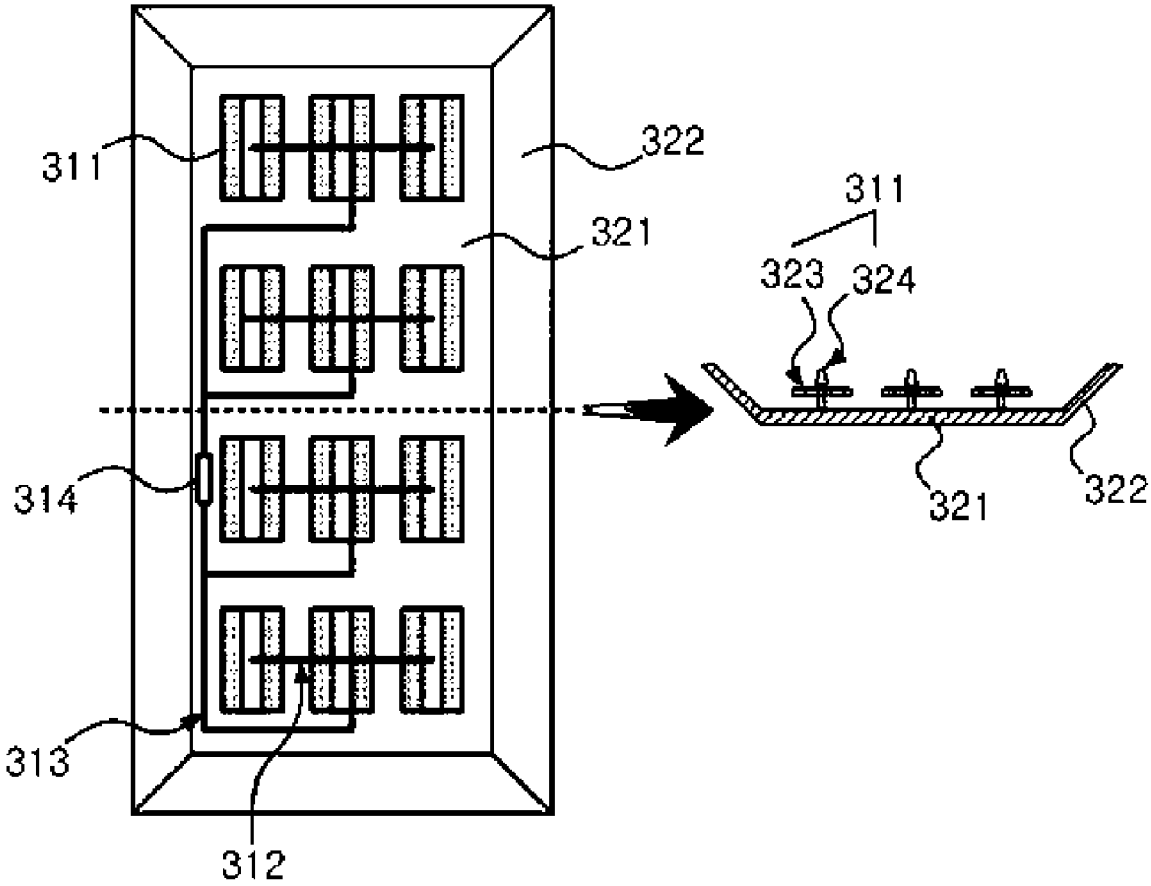
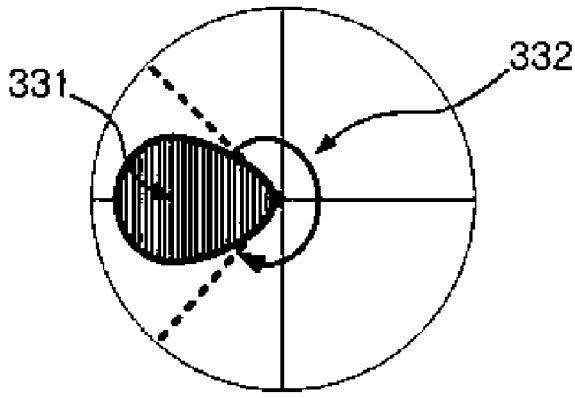
BACK-SUPPRESSED SIGNAL BEAM PATTERN DIAGRAM

ARRAY ANTENNA FOR SUPPRESSING BACK SIGNAL AND METHOD FOR DESIGNING THE SAME

CROSS-REFERENCE TO RELATED APPLICATION

This application is a 371 of PCT/KR05/01983 dated Jun. 24, 2005 and claims the benefit of Korean Patent Application No. 2004-48743, filed Jun. 28, 2004, the disclosure of which is hereby incorporated herein by reference in its entirety.

BACKGROUND OF THE INVENTION

1. Field of the Invention

The present invention relates to a front directional antenna used in a wireless communication system and, more particularly, to an isolation antenna for making transfer characteristics of a back signal zero (0).

2. Description of the Related Art

A method for designing a conventional isolation antenna includes an antennal element arranging step S11, a multi-back shielding step S12, a signal synthesizing step S13, and a back-suppressed pattern outputting step S14, as shown in FIG. 1.

At the antenna element arranging step S11, the antenna elements are arranged at a relatively broad interval (e.g., 0.7 to 1.5 wavelength) to obtain a high directional gain by using a small number of elements, a small number, i.e., 1 or 2 elements 111 are arranged in a horizontal direction and a large number, i.e., 4 to 10 elements are arranged in a vertical direction to reduce a size of the antenna.

The multi-back shielding step S12 is a step for repetitively placing refracted electric wave obstacles 115 and 116 to repetitively weaken receiving intensity of the back signal when the antenna element arranged by the element arranging step S11 receives the back signal.

The signal synthesizing step S13 is a step for synthesizing the signal received by the array element arranged at the element arranging step S11 to a state that the back signal is weakened by the multi-back shielding step.

The back-suppressed pattern outputting step S14 is a step for outputting the synthesized back-suppressed pattern signal to an outside of the antennal so that it can be used by a user.

Here, like a pattern 130 of FIG. 1, a pattern of the output signal has a main beam 131 whose half amplitude has a narrow angle (e.g., 20 degree) due to the refracted electric wave obstacles and a side lobe 132 which has a broad width.

However, the conventional isolation antenna has a problem in that a possible zero point angle 134 of the back signal is limited by size and number of the electric wave obstacles.

SUMMARY OF THE INVENTION

It is an object of the present invention to provide an antenna device which forms a main beam of various angles which is needed for the front direction and suppresses reception of the back signal at intensity of −30 db (1/1000) with respect to all back directions of 180 degree (e.g., 90~270 degree if it is assumed that the front direction is 0 degree), compared to the main beam and a method for designing the same.

The present invention provides a method for designing a front directional array antenna for suppressing a back signal used in a wireless communication, comprising: (a) an analogous pattern element arranging step for arranging, on a reflecting panel which is a conductor at a predetermined interval, elements having mutual analogous emission pattern characteristic for a short axis (x axis) in which the number of arrangements is small and for a long axis (y axis) which is a perpendicular direction to the x axis; (b) a reception balancing step for forming, in the edge of the reflecting panel, reflecting surfaces having a predetermined angle and length which are symmetric centering on the front surface to direction of electric wave arrived to the elements located in the edge; (c) an x-axis direction signal suppressing step, by x-axis series distribution and synthesis, for performing as many series distribution and synthesis suppressing transfer characteristic in an x-axis direction as the number of y rows, for output distribution and synthesis for the x axis arrangement, in synthesizing a signal of the array antenna after the step (b); (d) a y-axis direction signal suppressing step, by y-axis series distribution and synthesis, for performing series distribution and synthesis suppressing transfer characteristic in a y-axis direction in finally performing distribution and synthesis in the y-axis direction, for output distribution and synthesis for the x axis arrangement; and (e) a back-suppressed sold pattern outputting step for providing result of arrangement signal distribution and synthesis of the y axis to a contact means outside the antenna device.

At the step (a), the element performs load-matching using a small dipole which is relatively smaller than a $\lambda/2$ dipole, has a low height of less than $\lambda/4$ from the reflecting panel of the small dipole element, has a broad width of greater than of $\lambda/8$ as a width of the small dipole element, and has a front directional element added to the small dipole element.

As the series distribution for suppressing the transfer characteristics for the x or y axis, one of the binomial distribution function, Chebyshev function, Taylor function, and cosine on pedestal is selectively applied.

The present invention further provides a front directional array antenna used in a wireless communication system, comprising: a plurality of front direction antenna elements 311 having a broad width of greater than $\lambda/8$ as a width of a small dipole element 323 and coupling a front directional element 324 to have front directional characteristic and non-interference characteristic between the neighboring elements; a reflecting panel for plane-arranging and fixing the plurality of antenna elements at a height H of less than $\lambda/4$ in column (x) and row (y) and having a corner reflecting portion 322 which has a reflecting curvature of 20 to 60 degree which has a similar height to a height that the antennal element is fixed to adjust balance of emission pattern between the antennal elements located on both edge ends; an x-axis series distribution portion 312 applying a series distribution according to the binomial distribution to form a zero point for a short axis (x) in which the number of element arrangement is small among the antenna elements 311 arrange and fixed in column and row; a y-axis series distribution portion 313 applying a series distribution according to Chebyshev function with respect to a long axis in which the number of arrangements is great to the signal of the x-axis series distribution portion 312 to form a zero point for the y-axis; and an input-output portion 314 outputting a combination signal of the y-axis series distribution portion 313 to the external portion.

BRIEF DESCRIPTION OF THE DRAWINGS

The above and other features and advantages of the present invention will become more apparent to those of ordinary skill in the art by describing in detail preferred embodiments thereof with reference to the attached drawings in which:

FIG. 1 is a view illustrating a back signal suppressing method and an antenna device according to a conventional art;

FIG. 2 is a flow chart illustrating a method for designing an array antenna for suppressing the back signal according to the present invention;

FIG. 3 is a view illustrating an antenna device according to the present invention;

FIG. 4 is a view illustrating a corner reflecting portion according to the present invention;

FIG. 5 is a view illustrating back signal suppressing principle according to the present invention; and FIG. 6 is a view illustrating configuration of the antenna device and an example of measured pattern according to the present invention.

DETAILED DESCRIPTION OF THE INVENTION

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout the specification.

FIG. 2 is a flow chart illustrating a method for designing an array antenna for suppressing the back signal according to the present invention. As shown in FIG. 2, the method for designing the array antenna includes an analogous pattern element arranging step S21, a reception balancing step S22, an x-axis direction signal suppressing step S23, a y-axis direction signal suppressing step S24, and a back-suppressed solid pattern outputting step S25.

The analogous pattern element arranging step S21 is a step for making the respective antenna elements have the analogous pattern on a reflecting panel of the antenna. Since elements arranged on the edge and elements arranged on the central portion have different characteristics from each other due to mutual interference even though they are same in size, an error may occur in controlling the emission pattern of the array antenna, so that an undesirable beam pattern may be formed. For this reason, it is preferable to use the elements whose emission patterns are analogous in a state that they are arranged on the reflecting panel.

FIG. 3 is a view illustrating a method for making the antenna elements which have analogous emission patterns at a predetermined arrangement interval (e.g., half wavelength). In the conventional antenna element, the half wavelength ($\lambda/2$) dipole is used, and installation height H is a $\lambda/4$ from the reflecting panel 321. However, the antennal element of the present invention has a height ($\lambda/8$~$\lambda/16$) which is lower than the $\lambda/4$. Thus, the array antenna of the present invention can reduce strength of the reflecting interference which occurs between the neighboring elements by arranging the antenna elements closely to the reflecting panel 321.

In making up the antenna element of the low height, the element 323 is made to have a broad width W (e.g., greater than $\lambda/8$), so that it can shield Reverse-phase power generated on the reflecting panel 321 and induce front directivity, thereby reducing interference strength between the elements.

A front directional element 324 (e.g., projector) may be additionally arranged on the front portion of the respective elements 323 to reduce the interference between the neighboring elements.

Here, the emission element performs load-matching using a small dipole having a length L of $\lambda/4$ other than dipole of $\lambda/2$, so that the adjacent distance between the neighboring elements is separated to reduce the mutual interference.

The arrangement interval between the analogous emission pattern elements is preferably is $\lambda/2$ which is easy to control the side lobe.

At the reception balancing step S22, the signals received by the elements arranged on the edge have different gain and pattern which depend on the arrival direction of radio wave and which are asymmetric between both ends thereof.

For the foregoing reason, as shown in FIG. 4 which shows a corner reflecting portion according to the present invention, the reflector located on the edge needs appropriate interval, reflecting angle and height so that the antenna elements 311 located on both edge ends can induce the analogous emission pattern 214 characteristics.

That is, the reception balancing step S22 is a step for comparing the emission patterns of both edge ends by actual measurement and determining a model of the edge reflector like the corner portion 322 shown in FIG. 4.

The x-axis direction signal suppressing step S23 and the y-axis direction signal suppression step S24 are explained with reference to FIG. 5 which is a view illustrating a principle for suppressing the back signal.

The x-axis direction signal suppressing step S23 has a characteristic that the array antennal element which has undergone the analogous emission pattern element arrangement step S21 and the reception balancing step S22 freely controls the beam by a percentage of the distribution signal. In particular, there is a characteristic that the series distribution such as the binomial distribution of $\lambda/2$ interval forms limit zero point with respect to direction of the reflector's plane, i.e., direction of +90 and −90 degree assuming that front direction is 0 degree.

Here, in a case where the edge of the reflecting panel has an appropriate corner reflector model by the edge reception balancing step S22, the signal source of the back side does not have signal transmission path through a free space directly to all element of the array antenna, but when the emission pattern of the individual element is actually measured predetermined amount (e.g., about −20 db compared to the main beam) is measured. In the present invention the back signal receiving phenomenon is interpreted as that the back signal is coupled through the edge of the reflecting panel, resonates on the front of the reflecting panel and then re-emits to the front of the reflecting panel.

Thus, in the horizontal pattern 221 shown when the first series combination for the x axis is performed, the front signal and the emission pattern of the back portion according to the beam control model by the series distribution are interpreted as that the resonance signal of the y-axis on the reflecting panel is received in the polarization direction of the individual elements and the back signal remains if the beam control of the x-axis is performed to form a zero point to the x-axis.

The y-axis direction signal suppressing step S24 has a similar principal to the x-axis direction signal suppressing step S23 and has a characteristic that the series distribution is applied to the array antennal element which has undergone the analogous emission pattern element arrangement step S21 and the reception balancing step S22, and particularly the series distribution such as the binomial distribution of λ/2 interval forms limit zero point with respect to direction of the reflector's plane, i.e., direction of +90 and −90 degree on the y-axis if it is assumed that front direction is 0 degree.

Thus, forming the limit zero point to the y-axis causes secondary limit offset to the y-axis resonance signal of the back direction measured after suppression for the x-axis, thereby forming the emission patterns 223 and 224 which make the transfer characteristics of all back direction signal zero while maintaining the transfer characteristics of the front direction signal.

The back-suppressed solid pattern outputting step S25 is a step for outputting the front signal in which the back signal is removed by the x-axis direction signal suppressing step S23 using the short-axis line series synthesis and the y-axis directional signal suppressing step S24 using the long-axis line series synthesis to the external portion to be used in the outside of the array antenna.

Here, as the series distribution which suppresses the transfer characteristics to the x- and y-axes in the x-axis direction signal suppressing step S23 and the y-axis direction signal suppressing step S24, one of a binomial distribution, Chebyshev function, Taylor function, and cosine on pedestal is selected.

FIG. 6 is a view illustrating the antenna configuration and the pattern diagram according to the present invention.

As shown in FIG. 6, the antenna of the present invention is a front directional array antenna used in a wireless communication and includes a plurality of antenna elements 311, a reflecting panel 321 having a corner reflecting portion 322, an x-axis series distribution portion 312, a y-axis series distribution portion 313, and an input-output portion 314.

A plurality of antennal elements 311 has small dipole elements 323 whose width is broad, e.g., more than λ/8 to shield the anti-phase power generated on the reflecting panel 321 with respect to the whole surface of the reflecting panel 321, thereby inducing the front directivity to reduce the interference between the neighboring elements.

Further, the front directional element 324 such as a projector is additionally arranged on the front portion of the small dipole element 323 to thereby significantly reduce the interference between the neighboring elements.

The antenna element 311 is installed at a height of λ/4 from the reflecting panel 321 having the corner reflecting portion 322.

Here, the antenna elements 311 are preferably arranged at an interval of λ/2 which is easy to control the side lobe.

The reflecting panel 321 on which the corner reflecting portion 322 is formed is configured such that a plurality of antenna elements 311 are plane-arranged and fixed in row and column directions at a height of less than λ/4 in order to balance the emission pattern between the antenna element located on the edge and the antenna element located on the central portion, and has the corner reflecting portion 322 which has a reflecting curvature of 20 to 60 degree which has a similar height to the fixing height of the antennal element to adjust balance of the emission pattern between the antennal elements located on both edge ends.

The x-axis series distribution portion 312 applies the series distribution according to the binomial distribution to form the zero point to the x-axis.

The y-axis series distribution portion 313 applies the series distribution such as Chebyshev function to the signal of the x-axis series distribution portion 312 to form the zero point to the y-axis.

The input-output portion 314 output the combination signal of the y-axis series distribution portion 313 to the external portion.

Like the back-suppressed single pattern of FIG. 6, the actual emission patter by the antenna device of the present invention not only forms the perfect zero point for the back signal but also does forms a single beam 331 since the front side lobe does not occur due to characteristics of the binomial distribution of the λ/2 interval and also has a characteristic that the back zero point extends to the front.

Thus, there is an advantage in that the back signal always maintains the zero point and it is also possible to design widths of the front horizontal and vertical beams by the number of the arrangement elements of the x and y axes. Further, by applying various series distributions such as Chebyshev function, Taylor function, and cosine on pedestal as well as the binomial distribution as the series distribution for forming the perfect zero point, it is possible to freely determine the suppression degree for the x and y axes, and thus it is possible to control a front/back (F/B) ratio and it is also possible to design desired half-power angle, front/side (F/S) ratio and gain.

As described herein before, according to the array antenna of the present invention which is employed in the wireless communication system, it is possible to design maximum F/B ratio, and thus there is an effect of obtaining sufficient isolation performance for the direction for which communication is unnecessary.

In particular, the array antenna of the present invention can be applied to various wireless communication system such as an AMPS, CDMA, GSM, TRS, PSC, satellite broadcasting, WCDMA, portable Internet, PHS, military communication, data communication of CDMA EV-DO, etc. Since direct RF relay and shielding of the unnecessary wave can be performed, there are advantages in that it is possible to economically expand service area, and it is possible for the military to easily perform electronic war.

The invention claimed is:

1. A method for designing a front directional array antenna for suppressing a back signal used in a wireless communication, comprising:

(a) an analogous pattern element arranging step for arranging, on a reflecting panel which is a conductor at a predetermined interval, elements having mutual analogous emission pattern characteristic for a short axis (x axis) in which the number of arrangements is small and for a long axis (y axis) which is a perpendicular direction to the x axis;

(b) a reception balancing step for forming, in the edge of the reflecting panel, reflecting surfaces having a predetermined angle and length which are symmetric centering on the front surface to direction of electric wave arrived to the elements located in the edge;

(c) an x-axis direction signal suppressing step, by x-axis series distribution and synthesis, for performing as many series distribution and synthesis suppressing transfer characteristic in an x-axis direction as the number of y rows, for output distribution and synthesis for the x axis arrangement, in synthesizing a signal of the array antenna after the step (b);

(d) a y-axis direction signal suppressing step, by y-axis series distribution and synthesis, for performing series distribution and synthesis suppressing transfer characteristic in a y-axis direction in finally performing distribution and synthesis in the y-axis direction, for output distribution and synthesis for the x axis arrangement; and (e) a back-suppressed sold pattern outputting step for providing result of arrangement signal distribution and synthesis of the y axis to a contact means outside the antenna device.

2. The method of claim 1, wherein at the step (a), the element performs load-matching using a small dipole which is relatively smaller than a λ/2 dipole, has a low height of less than λ/4 from the reflecting panel of the small dipole element, has a broad width of greater than of λ/8 as a width of the small dipole element, and has a front directional element added to the small dipole element.

3. The method of claim 1, wherein as the series distribution for suppressing the transfer characteristics for the x or y axis, one of the binomial distribution function, Chebyshev function, Taylor function, and cosine on pedestal is selectively applied.

4. A front directional array antenna used in a wireless communication system, comprising:

a plurality of front direction antenna elements having a broad width of greater than λ/8 as a width of a small dipole element and coupling a front directional element to have front directional characteristic and non-interference characteristic between the neighboring elements; a reflecting panel for plane-arranging and fixing the plurality of antenna elements at a height H of less than λ/4 in column (x) and row (y) and having a corner reflecting portion which has a reflecting curvature of 20 to 60 degree which has a similar height to a height that the antennal element is fixed to adjust balance of emission pattern between the antennal elements located on both edge ends;

an x-axis series distribution portion applying a series distribution according to the binomial distribution to form a zero point for a short axis (x) in which the number of element arrangement is small among the antenna elements arrange and fixed in column and row;

a y-axis series distribution portion applying a series distribution according to Chebyshev function with respect to a long axis in which the number of arrangements is great to the signal of the x-axis series distribution portion to form a zero point for the y-axis; and an input-output portion outputting a combination signal of the y-axis series distribution portion to the external portion.

* * * * *